United States Patent [19]

Nakagawa et al.

[11] Patent Number: 4,803,777

[45] Date of Patent: Feb. 14, 1989

[54] METHOD OF MANUFACTURING AN ELECTRIC COMPONENT WITH A LEAD WIRE SECURED IN A THROUGH HOLE

[76] Inventors: Masayuki Nakagawa, Murata Seisakuso Tenjin-Ryo, 5-41, Tenjin 4-chome, Nagaokakyo-shi, Kyoto-fu; Makoto Tabuchi, 22-20, Sakurai 5-chome, Shimamoto-cho, Mishima-gun, Osaka-fu; Mitsuro Hamuro, 12-2, Kayogaoka 1-chome, Nagaokakyo-shi, Kyoto-fu, all of Japan

[21] Appl. No.: 762,963

[22] Filed: Aug. 6, 1985

[30] Foreign Application Priority Data

| | | | |
|---|---|---|---|
| Aug. 7, 1984 | [JP] | Japan | 59-166204 |
| Dec. 27, 1984 | [JP] | Japan | 59-281615 |
| Feb. 12, 1985 | [JP] | Japan | 60-25410 |

[51] Int. Cl.[4] ..... H01R 43/00

[52] U.S. Cl. ..... 29/856; 29/469.5; 29/525; 29/602.1; 156/91; 156/293; 336/192

[58] Field of Search ..... 29/854–856, 29/845, 525, 469.5, 458; 336/175, 192; 228/173.5; 333/81 R, 177, 12, 181, 185; 156/293, 295, 294, 423, 91

[56] References Cited

U.S. PATENT DOCUMENTS

| | | | |
|---|---|---|---|
| 4,146,854 | 3/1979 | Ishino et al. | 333/181 X |
| 4,247,981 | 2/1981 | Walters | 29/845 |
| 4,378,539 | 3/1983 | Swanson | 333/177 |

*Primary Examiner*—Carl E. Hall

[57] ABSTRACT

To manufacture an electronic component of the present invention and according to a method of manufacturing the electronic component also of the invention, steps of positioning and temporarily fixing the electronic component element are performed by the use of a bent portion formed on the lead wire, the bent portion of the lead wire being pressed into the through hole of the electronic component element. Thereafter, the bonding agent, which was applied to the bent portion, is filled into the through hole of the electronic component element by capillarity. Alternatively, the bonding agent may be injected into the through hole after the lead wire is inserted. Thus, the bonding agent is filled in a shorter time.

5 Claims, 3 Drawing Sheets

METHOD OF MANUFACTURING AN ELECTRIC COMPONENT WITH A LEAD WIRE SECURED IN A THROUGH HOLE

BACKGROUND OF THE INVENTION

The present invention relates to electronic components wherein a lead wire is extended through a through hole of a cylindrical electronic component element and is secured to the electronic component element with bonding agent, and to a method of manufacturing them.

Generally, in order to remove electrical noise coming from outside an appliance or noise generated by an appliance itself, various electronic components are used for various electronic appliances. As shown in FIG. 10, in one known type of electronic component a lead wire 2 is inserted through the through hole 1*a* of the cylindrical ferrite bead 1 to cause the ferrite bead 1 to function as an inductance with respect to noise passing through the lead wire 2, so as to prevent the noise from passing.

To manufacture such electronic component as shown in FIG. 10, a ferrite bead 1 and a lead wire 2 which was cut to a required length were provided. The lead wire 2 was inserted through the through hole 1*a* of the ferrite bead 1 and the ferrite bead 1 was positioned in a given location. Thereafter, ring-shaped stationary metal fixtures 3, 4 were externally engaged with respective ends of the lead wire 2. These stationary metal fixtures 3, 4 were moved until the stationary metal fixtures were applied respectively against both end faces of the ferrite bead 1. Then the stationary metal fixtures 3, 4 were deformed in the diametrical direction towards the lead wire 2, and thereby crimped, so as to secure the ferrite bead 1 in a given desired position on the lead wire.

When the electronic components were manufactured as described hereinabove, the ferrite bead 1 was difficult to position, because the lead wire 2 had no means for positioning the ferrite bead 1. The stationary metal fixtures 3, 4 were required to be crimped near both end faces of the ferrite bead 1, thus making it difficult to crimp the stationary metal fixtures 3, 4, thus resulting in lower productivity and improper mass-production.

SUMMARY OF THE INVENTION

Accordingly, an object of the present invention is to provide a method of manufacturing electronic components, comprising the steps of inserting a lead wire through the through hole of a cylindrical electronic component element, securing the electronic component, and thus improving the productivity of the electronic components without damaging the appearances of the electronic components, and simplifying the mass production.

Thus, according to the present invention, a bent portion, which has a bent width larger than the inner diameter of the through hole of the electronic component element, is formed in the lead wire for being secured within the cylindrical electronic component element. The bent portion is pressed into the through hole of the electronic component element, and bonding agent is filled between the bent portion of the lead wire and the through-hole inner wall of the electronic component element to secure the lead wire to the electronic component element. More particularly, according to the present invention, the positioning operation of the electronic component element includes steps in which the bending operation is performed for forming the lead wire, and liquid bonding-agent is fillingly penetrated, by the use of capillarity, into capillary gap to be formed between the bent portion of the lead wire and the through-hole inner wall of the electronic component element. The invention simplifies the positioning operation of the electronic component element and the bonding between the lead wire and the electronic component element.

Also, according to the present invention, a bent portion, which has the bent width larger than the inner diameter of the through hole of the electronic component element, is formed in the lead wire which is inserted into the cylindrical electronic component element and is secured therein. Liquid bonding agent is adhered on this bent portion and is pressed into the through hole of the electronic component element. Thereafter, the bonding agent is heated to reduce viscosity and is thereby filled between the bent portion of the lead wire and the through-hole inner wall of the electronic component element to secure the lead wire to the electronic component element.

Furthermore, the invention relates to a lead wire which has a bent engagement portion larger in width than the through-hole inner diameter of the cylindrical electronic component element. Both sides of this engagement portion are bent in advance, in a direction opposite to a foot bending direction to be caused when the engagement portion has been inserted into the through hole of the electronic component element is inserted under pressure into the through hole and is secured into the electronic component element with the bonding agent.

BRIEF DESCRIPTION OF THE DRAWINGS

These and other objects and features of the present invention will become apparent from the following description of preferred embodiments, thereof with reference to the accompanying drawings, in which.

BRIEF DESCRIPTION OF THE INVENTION

Figure 1:
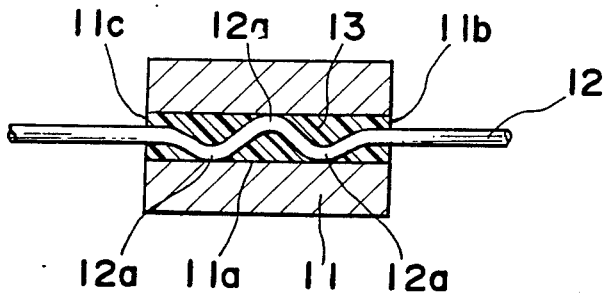
FIG. 1 is a cross-sectional view of an electronic component in accordance with the present invention.

Before the description of the present invention proceeds, it is to be noted that like parts are designated by like reference numerals throughout the accompanying drawings.

Referring now to the drawings, there is shown in FIG. 1 an electronic component according to the present invention. First, a method of manufacturing the electronic component will be described with reference to the embodiments shown from FIG. 2 to FIG. 6.

Figure 2:
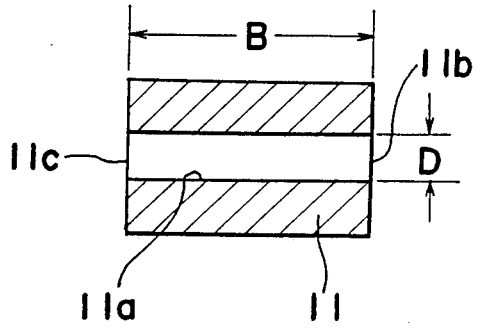
FIG. 2 is a cross-sectional view of a ferrite bead of FIG. 1.

As shown in FIG. 2, a ferrite bead 11 is provided as a cylindrical electronic component element, which is B in length and has a through hole 11*a* of D in diameter in the axial center portion.

Figure 3:
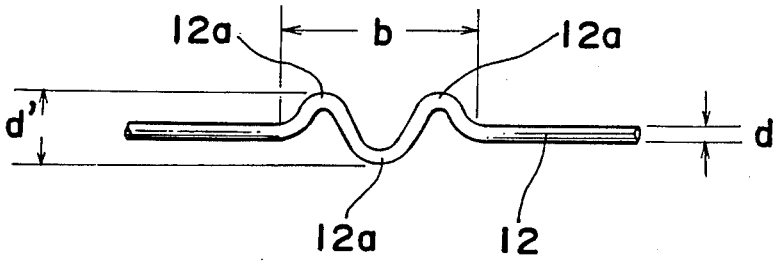
FIG. 3 shows the lead wire of FIG. 1, FIGS. 4(*a*) through (*c*) are views showing one embodiment of a manufacturing method in accordance with the present invention.

Similarly, as shown in FIG. 3, a lead wire 12 of d in diameter is provided. The lead wire 12 is provided, at its approximate central portion, with at least one bent portion 12*a* having a bent width d' larger than the diameter D of the through hole 11*a* of the ferrite bead 11. The bent portion has length b ($\leqq$B) which is less than or equal to the length B of the ferrite bead 11.

Figure 5:
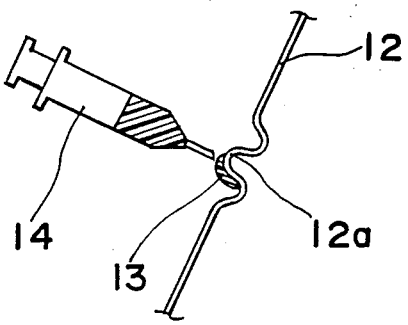
FIG. 5 and FIG. 6 are respectively views showing two processes of adhering the bonding agent on the lead wire, FIGS. 7(*a*) through (*c*) are views showing another embodiment of the manufacturing method of the present invention.
Figure 6:
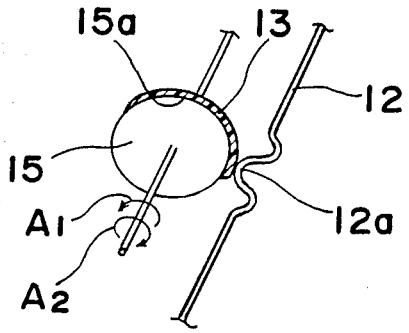

As shown in FIG. 5, a given amount of bonding agent 13 of prescribed viscosity is applied, by a dispenser 14, on the bent portion 12*a* formed on the lead wire 12 as described hereinabove. Or, as shown in FIG. 6, the bonding agent 13 is fed onto the outer peripheral face 15*a* of a roller 15 rotating in a direction shown by an arrow A1 or A2, and a given amount of bonding agent 13 is applied upon the bent portion 12*a* through the contact of the bent portion 12*a* of the lead wire 12 against the outer peripheral face of the roller 15. The application amount of the bonding agent 13 is desirably should not exceed the amount to be filled between the inner wall of the through hole 11*a* of the ferrite bead 11 and the lead wire 12. Thermo-setting resin such as epoxy resin, silicone resin, phenol resin, unsaturated polyester resin or the like may be used as the bonding agent. Also, acrylate resin, styrene resin or the like may be used as thermo-plastic resin.

Figure 4A:
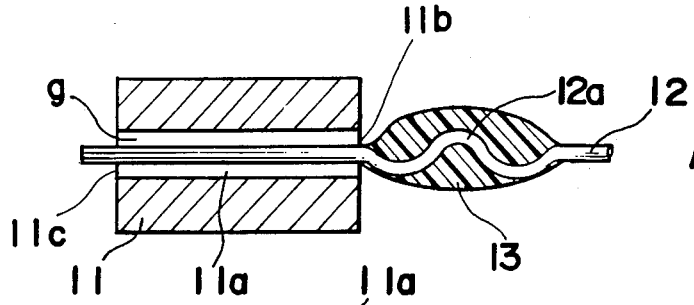
Figure 4B:
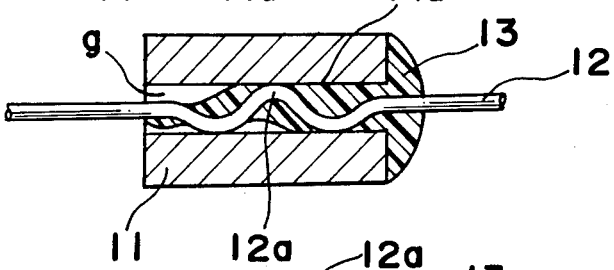
Figure 4C:
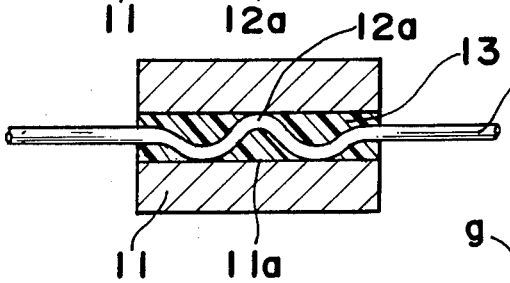

As shown in FIG. 4(*a*), the lead wire 12 with the bonding agent 13 applied upon the bent portion 12*a* thereof as described hereinabove is inserted from a first end opening 11*b* into the through hole 11*a* of the ferrite bead 11. As shown in FIG. 4(*b*), the lead wire bent portion 12*a* with bonding agent 13 applied thereon is pressed into the through hole 11*a* of the ferrite bead 11.

One portion of the bonding agent 13 is introduced, together with the bent portion 12*a* of the lead wire 12, into the through hole 11*a* of the ferrite bead 11 and the remaining bonding agent is adhered externally on the first end opening 11*b*.

A ratio between the diameter D of the through hole 11*a* of the ferrite bead 11 and the diameter d of the lead wire 12 is adapted to be such a value that at least the liquid bonding agent 13 causes capillarity in the capillary gap g leading to the second end opening 11*c* from first end opening 11*b* of the through hole 11*a*, said capillary gap g being formed between the inner wall of the through hole 11*a* of the ferrite bead 11 and the lead wire 12.

Accordingly, the bonding agent 13 applied upon the bent portion 12*a* of the lead wire 12 moves towards the second end opening 11*c* into the capillary gap g from the first end opening 11*b* of the through hole 11*a* of the ferrite bead 11. The external portion of the bonding agent 13 adhered externally on the first end opening 11*b* of the ferrite bead 11 shown in FIG. 4(*b*) is also brought almost completely into the through hole 11*a* of the ferrite bead 11 as shown in FIG. 4(*c*), thereby filling the through hole.

To carry out the filling operation in which, for example, d=0.65 mm, D=1.0 mm, the bonding agent is composed of thermo-setting epoxide resin, of 70,000±15,000 cps in viscosity and the temperature is 25° C. through 30° C., requires 120 seconds to 180 seconds.

When the bonding agent 13 is set in this condition, the ferrite bead 11 is secured to the bent portion 12*a* of the lead wire 12.

In this manner, the bent portion 12*a* of the lead wire 12 functions to position the ferrite bead 11 and to temporarily secure the ferrite bead 11 until the bent portion 12*a* of the lead wire 12 is inserted into the ferrite bead 11 and the bonding agent 13 is set. Also, the bonding agent 13 is brought into the through hole 11*a* of the ferrite bead 11 by the capillarity so that no projection of the bonding agent 13 from the end face of the ferrite bead 11 occurs, and the electronic components are not damaged in appearance by the bonding agent 13.

Such electronic components as shown in FIG. 4(*c*), i.e., FIG. 1, are provided by the above-described manufacturing method. Namely, this electronic component has a lead wire 12 inserted into the through hole 11*a* of a cylindrical electronic component element 11 to secure the lead wire 12 to the electronic component element 11. The lead wire 12 which is smaller in diameter than the inner diameter D of the through hole 11*a* of the electronic component element is provided with a bent portion 12*a* of bent width d' larger than the inner diameter D, and is inserted through the through hole 11*a* to have its bent portion 12*a* come into pressure contact in the through hole 11*a*. The bonding agent 13 is moved towards the interior from the outside of the through hole 11*a*, by the capillarity, in the capillary gap g to be formed between the through hole 11*a* of the electronic component element 11 and the lead wire 12 inserted into the through hole 11*a*, and is filled within the through hole 11*a*. Also, to provide such capillarity, the capillary gap g to be formed between the through hole 11*a* of the electronic component element 11 and the lead wire 12 inserted through the through hole 11*a* is set in the range of 0.05 mm through 0.5 mm, preferably of 0.05 mm through 0.3 mm.

Thus, according to the present invention, the positioning and temporary fixing operations of the ferrite bead are effected by the use of the bent portion formed on the lead wire with the electronic component having the lead wire secured into the through hole of the ferrite bead, and the bonding agent is adapted to be filled into the through hole of the ferrite bead by the use of the capillarity. Therefore, the bonding agent is fed without waste in a condition where the ferrite bead is positively positioned in a given position. Electronic components which are superior in appearance and are marketable may be easily manufactured in mass.

In the process as shown in FIG. 4(*b*), a hot blast is blown at the bonding agent such as liquid epoxy resin attached on the lead wire, or the bonding agent is heated to a given temperature within a furnace, to reduce the viscosity. The bonding agent 13 adhered on the outside of the first end opening 11*b* may then pass into and be accommodated within the through hole 11*a* in a short time. Furthermore the bonding agent 13 is heated at high temperatures after all the bonding agent 13 has been accommodated within the through hole 11*a*, and is hardened.

In this case, the heating operation for reducing the viscosity of the bonding agent 13 may be effected within the same hardening furnace or the like simultaneously without separation of the heating operation for the hardening.

It is to be noted that the bonding agent 13 is desired to be heated at a lower temperature than the melting temperatures of solder, when the lead wire is covered with solder.

In a case where, for example, d=0.65 mm, D=1.0 mm, a bonding agent whose viscosity at normal temperatures (25° C. through 30° C.) is 70,000±15,000 cps is used. The filling operation is completely performed in 10 to 30 seconds when it is heated at 125° C., thereby extremely simplifying the manufacture of the electronic components.

Figure 7A:
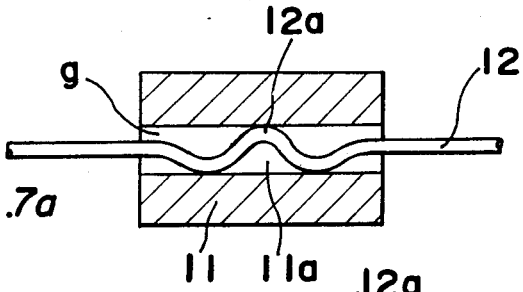
Figure 7B:
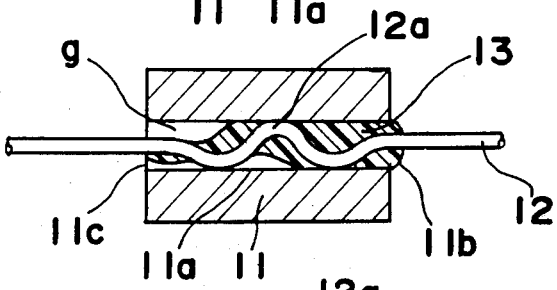
Figure 7C:
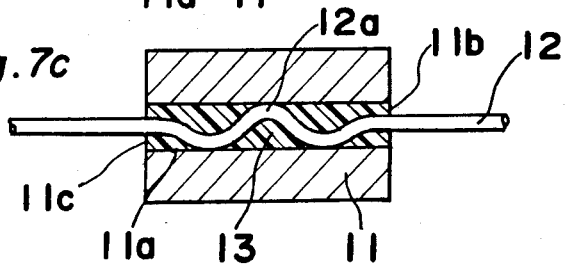

The electronic components of the present invention may be provided also by a manufacturing method shown in FIGS. 7(*a*) through (*c*), instead of the manufacturing method of FIG. 4. According to this manufacturing method, the bent portion 12*a* of the lead wire 12 is pressed into the through hole 11*a* of the ferrite bead 11 as shown in FIG. 7(*a*) and thereafter the bonding agent 13 is injected into the capillary gap g from the first end opening 11*b* of the ferrite bead 11 as shown in FIG. 7(*b*). The bonding agent 13 is moved towards the interior from the outside of the through hole 11*a* by the capillarity into the capillary gap g to be formed between the through hole 11*a* of the ferrite bead 11 and the lead wire 12 inserted through the through hole 11*a*, and is thereby filled within the through hole 11*a*.

Also, according to the manufacturing method of the present invention, the ratio between the diameter D of the through hole 11*a* of the ferrite bead 11 and the diameter d of the lead wire 12 is a value in which at least the liquid bonding agent 13 may be brought into the through hole 11*a* of the ferrite bead 11 by the capillarity in the capillary gap g, which leads to the second end opening 11*c* from the first end opening 11*b* of the through hole 11*a*, said capillary gap g being formed between the inner wall of the through hole 11*a* of the ferrite bead 11 and the lead wire 12.

Figure 8:
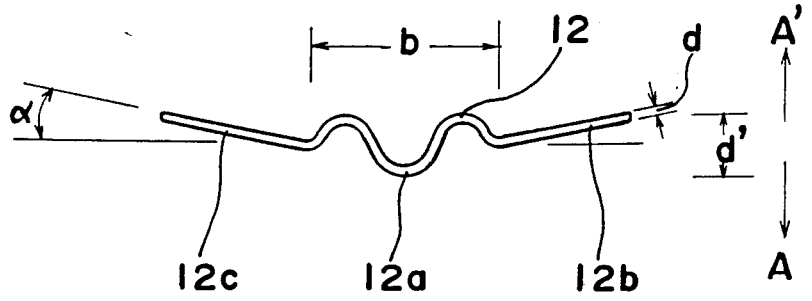
FIG. 8 shows a modified example of the lead wire of FIG. 3.

Furthermore the foot bending of the lead wire may be prevented from being developed by the use of the lead wire of such construction as shown in FIG. 8 as the lead wire to be used in the electronic component of the present invention.

Namely, a lead wire 12 of d in diameter is provided as shown in FIG. 8. The lead wire 12 is provided, at its approximate central portion, with a bent portion 12*a*, which has a bent width d' larger than the diameter D of the through hole 11*a* of the ferrite bead across the length b (≦B) less than or equal to the length B of the ferrite bead 11, and the lead wire portions 12*b*, 12*c* on both sides of the bent portion 12*a* are bent by α° in the direction of A' in the drawing. Namely, the bent angle α is calculated chiefly in accordance with the inner diameter D of the through hole 11*a* of the ferrite bead 11, the bent width d' of the lead wire 12 and the material properties of the lead wire 12. The bent angle α is set to a value wherein it may just become the axial direction of the ferrite bead by the foot bending along the A direction opposite to the A' direction of the lead wire portions 12*b*, 12*c* to be caused when the temporary fixing is performed through the pressed insertion of the bent portion 12*a* of the lead wire 12 into the through hole 11*a* of the ferrite bead 11. Also, although the foot bending direction A and the bent direction A' show directions shown for the sake of the description, reference character A shows a direction of the foot bending to be caused when the electronic component is manufactured, reference character A' shows a direction along which the bending operation is effected in advance so that the foot bending is negated to provide an extended line condition, thus being subject to changes respectively depending upon the reality.

Figure 9:
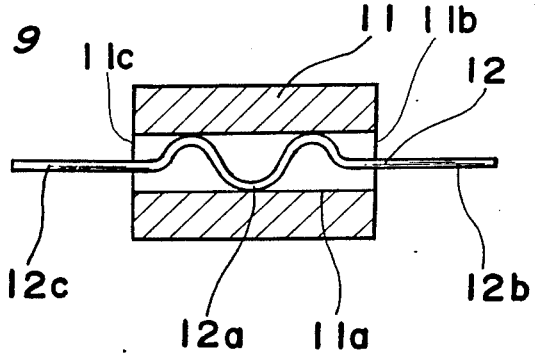
FIG. 9 is a cross-sectional view showing the lead wire of FIG. 8 inserted into the ferrite bead.
Figure 10:
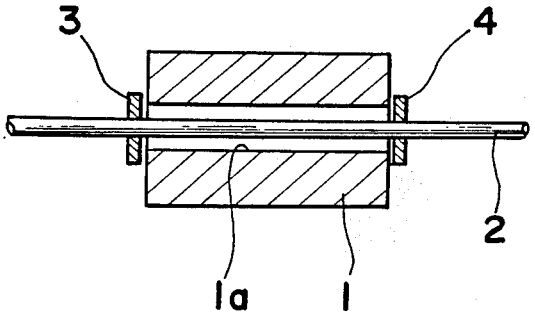
Fig. 10 PRIOR ART
FIG. 10 is a sectional view of the electronic component of the conventional example.

The lead wire 12 with the bonding agent 13 being applied upon the bent portion 12*a* in this manner is inserted from the first end opening 11*b* into the through hole 11*a* of the ferrite bead 11 and the bent portion 12*a* is pressed into the through hole to perform the temporary fixing operation. The lead wire portions 12*b*, 12*c* bent in advance by a given angle α into the A' direction, as shown in FIG. 9, by the foot bending into the A direction to be caused in the lead wire 12 at this time become just the axial direction of the ferrite bead 11, so that an inductance element without the foot bending is provided.

The present invention may be widely applied to the electronic components of a type in which the lead wire is secured with the bonding agent to the electronic component element.

It is to be noted that the construction of the electronic component of the present invention and the method of manufacturing the electronic components are achieved by the above-described methods, but are not restricted to the above embodiments. Needless to say, these methods may be properly changed within a range of variations which may occur to one skilled in the art, still within the scope of the invention, and still achieving the same advantageous results.

For example, the electronic component is not restricted to an axial type in shape, but may be radial in type.

Furthermore, the electronic component element is not restricted to the ferrite bead, but may be various other items.

Also, the shape of the engagement to be formed on the lead wire is not restricted to such bent portion as described in the above embodiment, but may be different in shape such as spiral or the like. Also, in a case where such bent portions as in the above embodiment are used, the number of the projections produced by the bending is three in the above embodiment. The number is not restricted, but may be three or more as desired.

Although embodiments of the present invention have been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A method of manufacturing electronic components comprising the steps of:

inserting a lead wire through a through hole of a cylindrical electronic component element, and securing the inserted lead wire with bonding agent to the electronic component element, and further comprising the steps of:

forming said lead wire to have a bent portion, which has a bent width d' which is larger than an inner diameter of the through hole of the electronic component element, the lead wire having a diameter smaller than the inner diameter of the through hole of the electronic component element, inserting the lead wire from a first end opening of the through hole of said electronic component element and pressing the bent portion into the through hole, thereby forming a capillary gap which leads from the first end of the through hole to the other second end, said capillary gap being disposed between the through hole and the lead wire forming the bent portion, and penetrating the liquid bonding agent from the outside of the through hole into the interior thereof by capillarity through the capillary gap, to fill the through hole with the bonding agent.

2. A method of manufacturing electronic components comprising the steps of:

inserting a lead wire through a through hole of a cylindrical electronic component element, and securing the inserted lead wire with bonding agent to the electronic component element, and further comprising the steps of:

forming said lead wire to have a bent portion, which has a bent width d' which is larger than an inner diameter of the through hole of the electronic component element, the lead wire having a diameter smaller than the inner diameter of the through hole of the electronic component element, applying a given amount of liquid bonding agent to the bent portion of said lead wire, inserting said lead wire having said bonding agent thereon from a first end opening of the through hole of said electronic component element and pressing the bent portion into the through hole, and penetrating said bonding agent from the outside of the through hole into the interior thereof by capillarity through a capillary gap which leads from said first end of the through hole to the other second end, said capillary gap being disposed between the through hole and the lead wire forming the bent portion, to fill the through hole with the bonding agent.

3. A method of manufacturing electronic components comprising the steps of:

inserting a lead wire through a through hole of a cylindrical electronic component element, and securing the inserted lead wire with bonding agent to the electronic component element, and further comprising the steps of:

forming said lead wire to have a bent portion, which has a bent width d' which is larger than an inner diameter of said through hole, the lead wire having a diameter smaller than the inner diameter of the through hole of the electronic component element, inserting said lead wire from a first end opening of the through hole of said electronic component element and pressing the bent portion into the through hole, and thereafter injecting the liquid bonding agent from the outside of the through hole into a capillary gap which leads from said first end of the through hole to the other second end, said capillary gap being disposed between the through hole and the lead wire forming the bent portion, to penetrate the liquid bonding agent into the interior from the outside of the through hole by capillarity through the capillary gap, so as to fill the through hole with the bonding agent.

4. A method of manufacturing electronic components comprising the steps of:

inserting a lead wire through a through hole of a cylindrical electronic component element, and securing the inserted lead wire with bonding agent to the electronic component element, and further comprising the steps of:

forming said lead wire to have a bent portion, which has a bent width d' which is larger than an inner diameter of said through hole, the lead wire having a diameter smaller than the inner diameter of the through hole of the electronic component element, adhering the liquid bonding agent to the bent portion, inserting the lead wire from a first end opening of the through hole of said electronic component element and pressing the bent portion into the through hole, forming a capillary gap which leads from the first end of the through hole to the other second end, said capillary gap being disposed between the through hole and the lead wire forming the bent portion, thereafter heating said bonding agent to have a lower viscosity, and penetrating the bonding agent from the outside of the through hole into the interior thereof by capillarity through the capillary gap, to fill the through hole with the bonding agent.

5. A method of manufacturing electronic components comprising the steps of:

inserting a lead wire through a through hole of a cylindrical electronic component element, and securing the inserted lead wire with bonding agent to the electronic component element, and further comprising the steps of:

forming the lead wire to have a bent portion, which has a bent width d' which is larger than the inner diameter of said through hole, said lead wire having a diameter smaller than the inner diameter of the through hole of the electronic component element, bending at a given angle and in a given direction both the end portions of the lead wire, said end portions being portions of said lead wire which run from both ends of the bent portion, inserting the lead wire from a first end opening of the through hole of said electronic component element and pressing the bent portion into the through hole, to cause both said end portions of the lead wire to lie approximately along a longitudinal axis of the through hole, forming a capillary gap which leads from said first end of the through hole to the other second end, said capillary gap being disposed between the through hole and the lead wire forming the bent portion, and penetrating the liquid bonding agent from the outside of the through hole into the interior thereof by capillarity through the capillary gap to fill the through hole with the bonding agent.

* * * * *

UNITED STATES PATENT AND TRADEMARK OFFICE

CERTIFICATE OF CORRECTION

PATENT NO. : 4,803,777

DATED : February 14, 1989

INVENTOR(S) : Masayuki Nakagawa et al.

It is certified that error appears in the above-identified patent and that said Letters Patent is hereby corrected as shown below:

On The Title Page, insert -- [73] Assignee: Murata Manufacturing Co., Ltd., Japan --.

Signed and Sealed this

Fifteenth Day of August, 1989

*Attest:*

*Attesting Officer*

DONALD J. QUIGG

*Commissioner of Patents and Trademarks*